United States Patent [19]

Flansburg

[11] 4,333,581

[45] Jun. 8, 1982

[54] MULTI-COMPARTMENT CONTAINER WITH POP-TOP AND COMMUNICATING DOOR

[75] Inventor: Donald G. Flansburg, Merced, Calif.

[73] Assignee: Henry H. Howard, Modesto, Calif.

[21] Appl. No.: 179,932

[22] Filed: Aug. 19, 1980

[51] Int. Cl.[3] ..... B65D 25/08; B65D 41/32

[52] U.S. Cl. ..... 220/20; 206/519; 206/522; 220/23; 220/269; 426/120

[58] Field of Search ..... 220/20, 23, 269, 270, 220/271; 206/219, 222; 426/120

[56] References Cited

U.S. PATENT DOCUMENTS

| | | | |
|---|---|---|---|
| 3,305,368 | 2/1967 | Bourelle | 206/219 |
| 3,743,520 | 7/1973 | Croner | 220/23 |
| 3,779,372 | 12/1973 | de Lloret | 206/222 |
| 4,094,435 | 6/1978 | Kennedy | 220/269 |

*Primary Examiner*—George E. Lowrance
*Attorney, Agent, or Firm*—Harvey B. Jacobson

[57] ABSTRACT

A container for beverages including an outer peripheral wall and upper and lower walls. The upper wall spans and is sealed relative to the upper marginal edges of the peripheral wall and includes a first elongated tab formed integrally therewith and downwardly tearable from the top wall into the container with one bendable end of the first tab portion remaining attached to the top wall. An upwardly opening partition wall is disposed within the container below the top wall and includes peripheral edges sealed relative to the top wall. The peripheral wall defines a closed chamber within the container below the top wall. The partition wall includes a second integral elongated tab tearable therefrom with one bendable end portion of the second tab remaining attached to the partition wall. Connecting structure is operatively associated with the first and second tabs operative to effect tearing of the second tab from the partition wall responsive to downward tearing of the first tab from the top wall. In a first form of the invention, the upwardly opening partition wall comprises a substantially semi-spherical cup-shaped member whose upper marginal edges are crimped and sealed not only to the upper marginal edges of the peripheral wall of the container but also the outer peripheral edges of the top wall and the first and second tabs are substantially vertically aligned with each other. In a second form, the cup-shaped partition wall underlies only one-half of the top wall and includes a substantially vertical side wall portion in which the second tab is formed.

10 Claims, 7 Drawing Figures

MULTI-COMPARTMENT CONTAINER WITH POP-TOP AND COMMUNICATING DOOR

BACKGROUND OF THE INVENTION

In many instances it is desirable to obtain a mixture of two freshly mixed components. For example, a flavoring liquid may be mixed with a base liquid to provide a refreshing drink, but the mixed liquids may react with each other in manner effecting a change in the over-all flavor of the mixture after an extended period of time. Accordingly, it is not desirable to market such mixtures in closed containers which may experience considerable shelf life before being purchased and opened. Rather, a need exists whereby a container for a beverage mixture may include two individual compartments therein containing liquids to be mixed before being consumed and constructed in a manner whereby an action effective to open the container will also be effective to communicate the two compartments therein whereby the two liquids may readily mix immediately prior to consumption.

Although various forms of multi-compartment containers of the type constructed in a manner whereby the individual compartments may be communicated with each other at the time the container is opened heretofore have been provided, most of these previously known forms of multi-compartment containers are not of the type presently being utilized to market various beverages.

Examples of various forms of multi-compartment containers including some of the general structural and operational features of the instant invention are disclosed in U.S. Pat. Nos. 3,039,644, 3,305,368, 3,320,767, 3,321,097, 3,470,929, 3,743,520, 3,779,372 and 4,094,435.

BRIEF DESCRIPTION OF THE INVENTION

The multi-compartment container of the instant invention includes a body which is substantially identical to a conventional aluminum beverage can and a top which may also be considered as substantially identical to the top of a conventional beverage can and which comprises a pop-top including a tearable and bendable tab portion. The container includes an upwardly opening partition wall disposed beneath the top wall and sealed relative thereto and the partition wall includes a second tearable tab portion which is automatically torn open responsive to the tearing open of the top wall tab portion. In this manner, two separate liquids within the container may be communicated with each other upon opening of the container.

The main object of this invention is to provide a beverage container constructed in a manner in which two separate beverages may be contained for long storage life and which may be automatically mixed upon the container being opened.

Another object of this invention, in accordance with the preceding object, is to provide a container which will conform to present day aluminum beverage can manufacturing processes.

Yet another important object of this invention is to provide a beverage container, in accordance with the preceding objects, and which may be vended in conventional vending machines independent of modifications thereto.

Yet another important object of this invention is to provide a container constructed in a manner whereby carbonated and non-carbonated liquids may be received in a single container and maintained as separate liquids until dispensing of the contents of the container therefrom is desired.

A final object of this invention to be specifically enumerated herein to to provide a multi-compartment container, in accordance with the preceding objects, and which will conform to conventional forms of manufactured, be of simple construction and automatic in operation, so as to provide a device that will be economically feasible, long lasting and relatively trouble-free.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
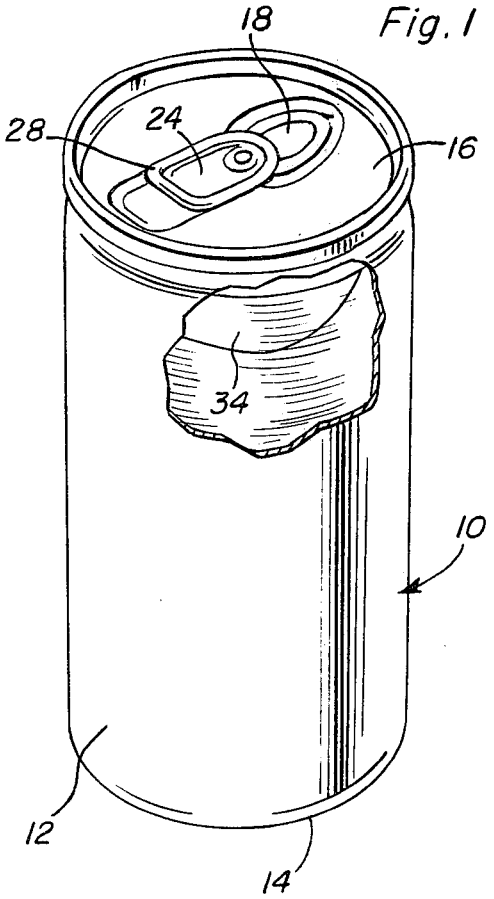
FIG. 1 is a perspective view of a container constructed in accordance with the present invention, a portion of the upper side wall of the container being broken away.
Figure 2:
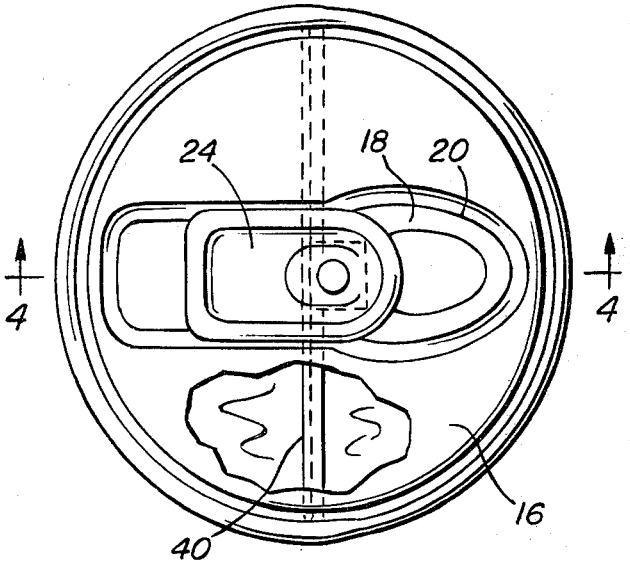
FIG. 2 is an enlarged top plan view of the container.
Figure 3:
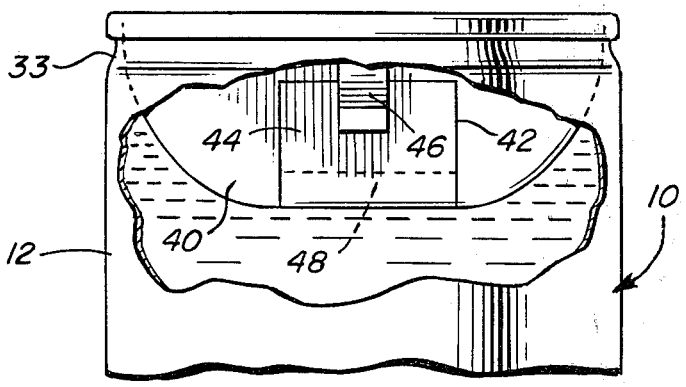
FIG. 3 is an enlarged elevational view of the upper portion of the container illustrated in FIG. 1, with portions of the near container side wall portion broken away.
Figure 4:
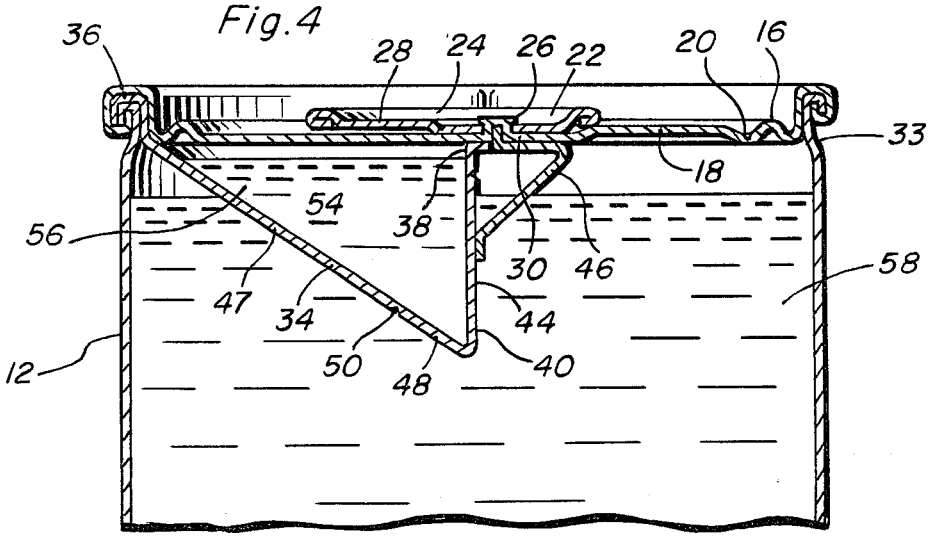
FIG. 4 is a fragmentary enlarged vertical sectional view taken substantially upon the plane indicated by the section line 4—4 of FIG. 2.

Referring now more specifically to the drawings, the numeral 10 generally designates a conventional form of liquid refreshment container including an outer cylindrical peripheral wall 12, a bottom wall 14 and a top wall 16. The top wall 16 is equipped with a first elongated tab portion 18 which may be substantially completely torn from the top wall 16 along a score or tear line 20. The tab portion 18 has one end 22 of an elongated lever 24 disposed thereover and the lever 24 has its midportion anchored relative to the top wall 16, as at 26. The other end 28 of the lever 24 projects endwise outwardly beyond a bendable zone 30 along which the tab portion 18 may be bent as the other end of the tab portion 18 is torn downwardly away from the top wall 16. The outer peripheral edge 32 of the top wall 16 overlies and is crimped and sealed relative to the upper marginal portions 33 of the outer peripheral side wall 12 of the container 10.

The foregoing may be considered as conventional liquid refreshment container construction.

The container 10, however, includes an upwardly opening partition wall 34 which underlies the top wall 16 and includes a semi-circular marginal edge portion 36 which underlies a corresponding portion of the outer peripheral edge 32 of the top wall 16 and overlies the adjacent area of the upper marginal portion 33 of the outer peripheral side wall 12 of the container. The marginal edge portion 36 is crimped and sealed relative to the top wall 16 and the outer peripheral side wall 12. In addition, the upwardly opening cup-shaped partition 34 includes a generally straight upper marginal portion 38 which extends generally along a diameter of the container 10 and is secured and sealed relative to the underside of the top wall 16. The straight upper marginal portion 38 comprises the upper marginal edge of a generally vertical plane wall portion 40 of the partition 34 and the planar wall portion 40 includes a score or tear line 42 corresponding to the score or tear line 20 defining a second tab portion 44. An elongated inclined connecting member 46 has its upper end secured to the downwardly swingable underside portion of the tab portion 18 and the lower end thereof secured to the outer surface of the second tab portion 44. In addition, the partition 34 includes an inclined wall 47 having a third tab portion 48 supported therefrom and defined by a score or tear line 50 and the tab portion 48 is joined to the lower end of the tab portion 44 whereby inward movement of the tab portion 44 will cause downward movement of the tab portion 48, see FIG. 5.

Figure 5:
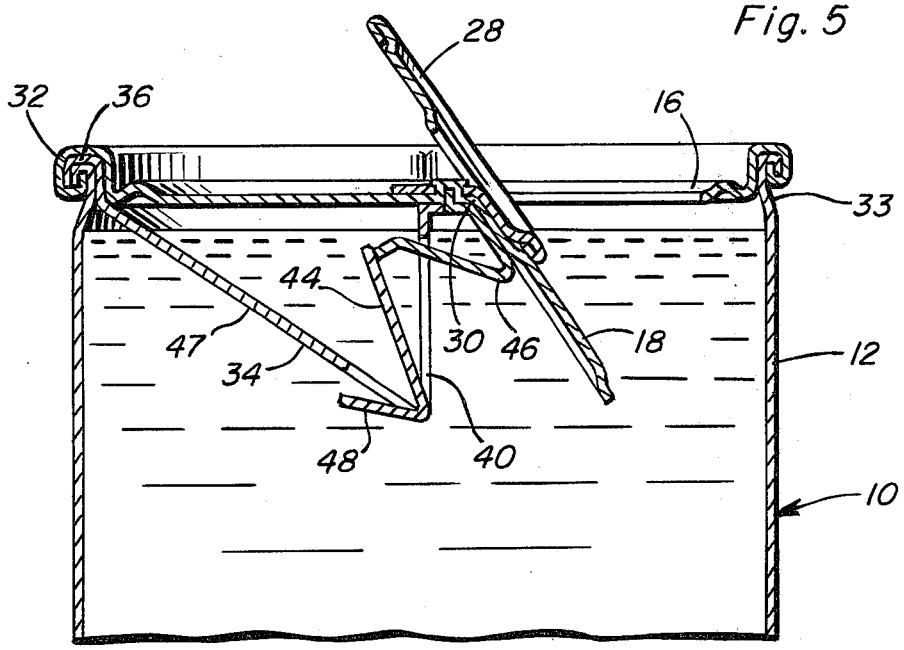
FIG. 5 is a fragmentary vertical sectional view, similar to FIG. 4, but illustrating the tab portions of the container in open positions.

In operation, when the end portion 28 of the lever 24 is pulled upwardly away from the top wall 16, the tab portion 18 is downwardly torn from the top wall 16 in the manner illustrated in FIG. 5 of the drawings. This operation of a container opening tab portion is conventional. However, as the tab portion 18 is torn downwardly from the top wall 16, the connecting member 46 pushes inwardly upon the tab portion 44 and inwardly tears the latter from the planar wall portion 40 and also effects downward tearing of the tab portion 48 from the wall portion 46. Thus, the separate sealed compartment 54 defined within the partition 34 within the container 10 is communicated with the remainder of the interior of the container 10 upon the tab portion 18 being downwardly torn from the top wall 16 and the liquid 56 within the compartment 54 may readily mix with the liquid 58 within the remainder of the interior of the container 10. For example, the liquid 56 may comprise tomato juice and the liquid 58 may comprise an alcoholic beverage.

Figure 6:
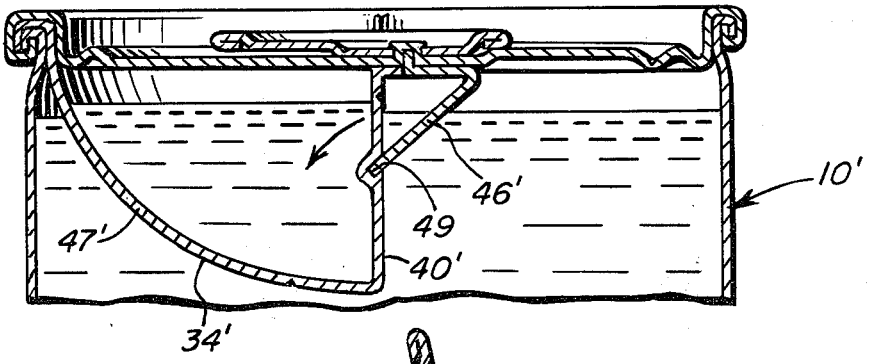
FIG. 6 is a fragmentary vertical section view, similar to FIG. 5, but illustrating a slightly modified form of the structure illustrated in FIGS. 1 through 5.

With attention now invited more specifically to FIG. 6 of the drawings, there may be seen a slightly modified form of container referred to in general by the reference numeral 10'. The container 10' is substantially identical to the container 10, except that the wall portion 47' of the upwardly opening partition 34' is partially spherical and the lower end of the connecting member 46' corresponding to the connecting member 46 is seated within an outwardly opening socket 49 formed in the planar wall portion 40'. Otherwise, the structure and thus the operation of the container 10' is identical to that of the container 10.

Figure 7:
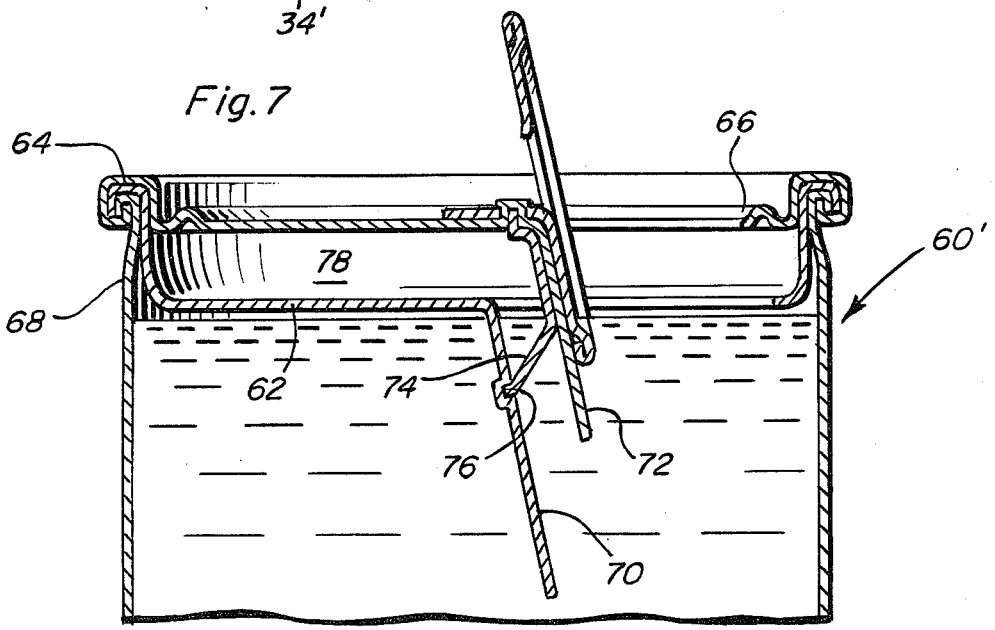
FIG. 7 is a fragmentary vertical section view, similar to FIG. 5. but illustrating a second form of multi-compartment container.

With reference now more specifically to FIG. 7 of the drawings, there may be seen a third form of container referred to in general by the reference numeral 60. The container 60 is similar to the container 10, except that the partition 62 thereof is full cup-shaped and the marginal edge portions 64 thereof are crimped and sealed relative to the container top wall 66 and upper marginal edges of the container side wall 68 fully about the upper end of the container 60. Also, the tab portion 70 formed in the partition 62 is spaced vertically below the tab portion 72 formed in the top wall 66 and the connecting member 74 extending downwardly from the underside of the tab portion 72 is seated within an upwardly opening recess 76 formed in the tab portion 70 intermediate the opposite ends.

Of course, the manner in which the container 60' is opened is substantially identical to the manner in which the container 10 is opened and the compartment 78 disposed within the confines of the partition 62 immediately beneath the top wall 66 are automatically discharged into the remainder of the interior of the container 60'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A container for beverages, said container including an outer peripheral wall and top and bottom walls, said top wall spanning and being sealed relative to the upper marginal edges of said peripheral wall, said top wall having a first elongated tab portion formed integrally therewith and downwardly tearable from said top wall into said container with one bendable end of said first tab portion remaining attached to said top wall, an upwardly opening partition wall disposed below said top wall and including peripheral edges sealed relative to said top wall and defining a closed chamber within said container below said top wall, said partition wall including a second elongated tab portion formed integrally therewith and tearable therefrom with one bendable end portion of said second tab portion remaining attached to said partition wall, and connecting means attached to said first and second tab portions operative to effect tearing of said second tab portion from said partition wall response to downward tearing of said first tab portion from said top wall.

2. The combination of claim 1 wherein said upwardly opening partition wall comprises a cup-shaped wall whose upper peripheral portions are crimped over and sealed relative to the upper marginal edges of said outer peripheral wall, the outer peripheral edge of said top wall overlying the upper peripheral crimped portions of said partition wall and also being crimped and sealed relative to said upper marginal edges of said peripheral wall and the upper peripheral portions of said partition wall.

3. The combination of claim 2 wherein said first and second tab portions are disposed in vertically spaced relation.

4. The combination of claim 3 wherein said connecting means includes an elongated thrust member carried by and depending from said first tab portion intermediate its opposite ends and having its lower end engaged with said second tab portion intermediate its opposite ends.

5. The combination of claim 4 wherein said second tab portion defines an upwardly opening recess in which the lower end of said thrust member is received.

6. The combination of claim 5 including an elongated lever having one end overlying and anchored to said one tab portion and the other end extending endwise outwardly beyond said one bendable end of said first tab portion.

7. The combination of claim 1 wherein said upwardly opening partition wall underlies generally one-half, only, of said top wall.

8. The combination of claim 7 wherein said upwardly opening partition wall includes a generally vertical wall portion in which said second tab portion is disposed.

9. The combination of claim 8 wherein said connecting means is disposed inwardly of said container below said top wall, but exteriorly of said chamber.

10. The combination of claim 8 wherein said upwardly opening partition wall also includes a lower bottom wall portion disposed to one side of and intersecting with said vertical wall portion, said bottom wall portion including a third tab portion formed integrally therewith and tearable downwardly therefrom, the intersecting portions of said vertical wall portion and bottom wall portion including an area thereof connecting said second and third tab portions whereby tearing of said tab portion toward an open position will also effect tearing of said third tab portion downwardly from said bottom wall portion.

* * * * *